United States Patent [19]

Prevotat

[11] 4,234,862

[45] Nov. 18, 1980

[54] ROBUST POLYPHASE TRANSFORMER

[75] Inventor: Gérard Prevotat, Nevers, France

[73] Assignee: Alsthom-Unelec, Paris, France

[21] Appl. No.: 922,699

[22] Filed: Jul. 7, 1978

[30] Foreign Application Priority Data

Jul. 22, 1977 [FR] France ..... 77 22536

[51] Int. Cl.[3] ..... H01F 33/00

[52] U.S. Cl. ..... 336/5; 336/60; 336/212; 336/219

[58] Field of Search ..... 336/5, 10, 12, 214, 336/215, 212, 213, 234, 225, 228, 219, 60

[56] References Cited

U.S. PATENT DOCUMENTS

| | | | |
|---|---|---|---|
| 2,488,391 | 11/1949 | Ford et al. | 336/213 X |
| 2,702,887 | 2/1955 | Joublanc | 336/5 |
| 2,761,107 | 8/1956 | Kane | 336/215 X |
| 3,201,734 | 8/1965 | Halacsy | 336/213 X |
| 3,222,626 | 12/1965 | Feinberg et al. | 336/219 X |
| 3,528,863 | 9/1970 | Foster et al. | 336/219 X |

FOREIGN PATENT DOCUMENTS

| | | | |
|---|---|---|---|
| 2314355 | 10/1973 | Fed. Rep. of Germany | 336/215 |
| 2225820 | 8/1974 | France | 336/5 |
| 994898 | 6/1965 | United Kingdom | 336/5 |
| 1361436 | 7/1974 | United Kingdom | 336/5 |

*Primary Examiner*—Thomas J. Kozma

*Attorney, Agent, or Firm*—Sughrue, Rothwell, Mion, Zinn and Macpeak

[57] ABSTRACT

A polyphase sector type transformer includes one magnetic core ring per phase, each of which has two rectilinear sides which are adjacent to each other. Each rectilinear side of one magnetic core ring is disposed contiguously with one of the rectilinear sides of an adjacent core ring whereby each magnetic core ring occupies a sector of the magnetic circuit of the transformer. Each pair of contiguous rectilinear sides is threaded through a coil of the transformer said coils comprising a high tension winding of trapezoidal cross-section and a low tension winding of rectangular cross-section. Each magnetic core ring

- is symmetrical about the plane of symmetry of the two coils which it threads;
- comprises an assembly of two generally arcuate parts arranged to facilitate threading of the coils on the rectilinear sides before the said core parts are joined by adhesive, the parts being separated along a plane perpendicular to the said plane of symmetry by sawing and;
- is made of a binder-impregnated, laminar stack of magnetic sheets of at least two different widths such that two contiguous rectilinear sides of two adjacent cores threading a single coil combine to give a magnetic circuit within the coil having a right cross-section which includes steps at the changes from one thickness of sheet to another and thereby forms a closer approximation to an ellipse than would a rectangular made from magnetic sheets all of the same width.

1 Claim, 3 Drawing Figures

ROBUST POLYPHASE TRANSFORMER

FIELD OF THE INVENTION

The present invention relates to a polyphase transformer, having one magnetic core for per phase, each core having two adjacent rectilinear sides, each of which is disposed against one of the rectilinear sides of an adjacent magnetic core, and each core threading a coil which comprises a high tension winding of trapezoidal right cross-section and a low tension winding of rectangular right cross-section, each magnetic core being symmetrical about the plane of symmetry of two adjacent coils and being impregnated with a varnish or a resin.

BACKGROUND OF THE INVENTION

The applicant's British Pat. No. 1,361,436 describes a polyphase transformer of this kind, the so-called sector type, in which each magnetic core is obtained from a magnetic sheet which is wound on a mandrel of the same shape as the magnetic circuit, and is then annealed thereon. The core thus obtained is then cut up into units, which are threaded through both the coils for which they provide the magnetic circuit and they are then reassembled. Such transformers are satisfactory for moderate powers, but for the construction of high power transformers, e.g. above 315 KVA, they take a very long time to manufacture and it becomes excessively difficult to compact the laminations of magnetic sheets.

Indeed manufacture becomes very lengthy and the difficulties in compacting the magnetic sheets become excessive as soon as the thickness of the magnetic circuit increases somewhat. Further, for high levels of power, they do not stand up sufficiently to the electrodynamic forces acting on the magnetic circuits or on the coils. Because of their rectangular shape, the coils are difficult to manufacture with conductors of large cross-section, and they cannot withstand a complete short-circuit. Further still, it becomes impossible to maintain the levels of heating and noise to acceptable values without prohibitive increases in the quantities of iron in the magnetic circuit and of metal of high conductivity (copper or aluminium) in the coils.

Preferred embodiments of the present invention remedy the above drawbacks and enable manufacture of polyphase sector transformers even for high power levels said transformers being of relatively easy manufacture and sufficiently robust to withstand the electrodynamic forces adequately, even in the event of a complete short circuit, and having acceptable noise and heating levels, without using excessive quantities of iron and metal of high conductivity.

SUMMARY OF THE INVENTION

The polyphase transformers according to the invention is characterized in that its varnish- or resin-impregnated magnetic cores are sawn into two parts along a plane perpendicular to their plane of symmetry, the two parts then being stuck together again, and in that they are made from magnetic sheets of at least two different widths so as to provide a right cross-section including at least one step.

Preferably, the sides of the high tension windings of two adjacent coils are separated by a single wedge lying in the plane of symmetry of the core that threads both of the said coils.

For a polyphase transformer which is cooled by oil contained in a tank, which is the usual case, it is advantageous for the uppermost coil in the tank to be horizontally disposed so that its cooling channels are vertical while the other coils, of which at least some are tilted at an angle to the horizontal, e.g. 30° in the case of a three-phase transformer, are disposed further down in the tank and are thus in contact with oil which, on average, is cooler. This provides some degree of compensation in coding with less efficient oil circulation in the tilted channels being compensated by the use of cooler oil, and more efficient oil circulation in the vertical channels being compensated by the use of hotter oil.

A three-phase sector transformer in accordance with the invention is described below by way of example with reference to the accompanying drawing.

DESCRIPTION OF THE PREFERRED EMBODIMENTS

Figure 1:
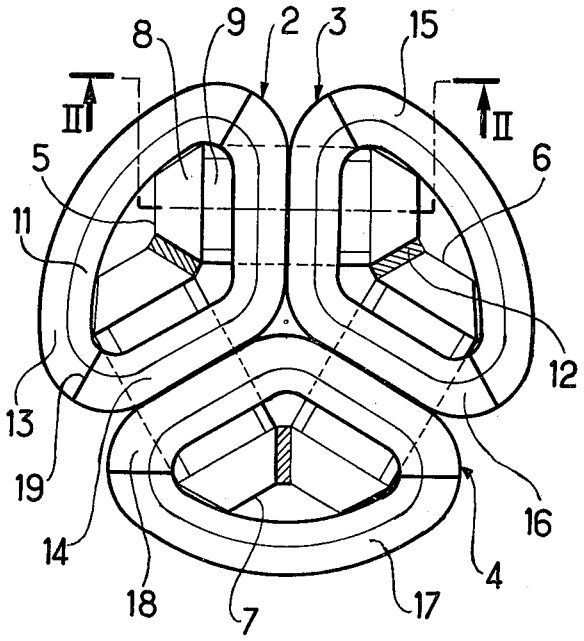
FIG. 1 is an elevation of the transformer.

In FIG. 1, magnetic circuits 2, 3, ad 4 pass respectively through coils 7 and 5, 5 and 6, and 6 and 7. Each coil such as 5 comprises a high tension winding such as 8 and a low tension winding such as 9. The high tension windings have a trapezoidal cross-section whose average width is equal to that of the low tension windings 9 which are of rectangular cross-section.

Figure 2:
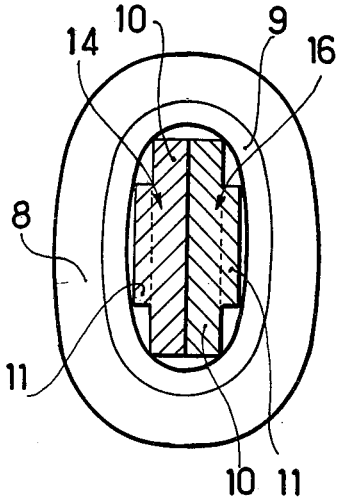
FIG. 2 is a cross-section along II—II of FIG. 1.

The magnetic circuits are composed of two parts such as 13 and 14, 15 and 16, and 17 and 18 which are obtained from a ribbon of magnetic sheet material which is shaped, annealed, impregnated with a varnish, and then sawn along saw planes such as 19, (see FIG. 3); the two parts are stuck together after the coils have been mounted on their corresponding magnetic cores. Each part of the magnetic cores comprises magnetic sheets of two different widths, namely wider sheets 10 and narrower sheets 11, thereby forming a step as can be seen in FIG. 2. The presence of this step gives the right cross-section of the magnetic core a shape which approaches that of a half ellipse (which could be approached even more closely by providing one or two extra steps, but naturally at the cost of complicating the manufacture). The pseudo-ellipsoidal cross-section ensures that the coils withstand the radial electrodynamic forces very much better than analogous coils of rectangular cross section. Further, the realization of the magnetic circuit in two parts which are impregnated and separated by sawing and then stuck together again provides good mechanical strength and reduces vibration, thereby reducing noise level.

The coils are wedged against each other by means of wedges such as 12 disposed between the high tension windings of two adjacent coils. These wedges jam the coils both axially and radially by decomposition of the tightening force into two orthogonal components, one perpendicular to the plane of symmetry of the coil and the other parallel thereto, whereby the coils wedge each other mutually.

The use of magnetic cores having a step and the use of high tension windings whose right cross section is trapezoidal also enables a reduction of the lengths of the magnetic sheets and of copper or aluminum necessary for respectively constituting the magnetic circuit and the windings and thereby reduces the mass of metal and also reduces heating.

The disposition of the coils shown in FIG. 1, where the coil 5 which is in the upper part of the tank where the hottest part of the oil is to be found is disposed horizontally so that its cooling channels are vertical provides for most efficient overall cooling, since the other two coils which are 30° to the horizontal and which therefore suffer from diminished circulation of the coil in their cooling channels, benefit from the use of oil whose average temperature is cooler.

FIG. 2 shows the form of the step in the magnetic core more clearly (wider sheets 10, narrower sheets 11) with the core surrounded by the low tension winding 9 and the high tension winding 8.

Figure 3:
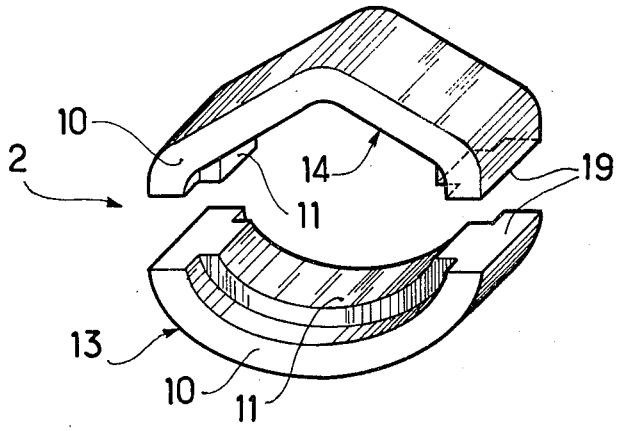
FIG. 3 is a perspective view of the two halves of a magnetic core, after they have been sawn apart and before they have been stuck together again.

FIG. 3 shows the appearance of the two halves 13 and 14 of a magnetic core shown in perspective, after the core has been sawn into two parts along the saw plane 19 and before the parts have been stuck together again.

While the transformer structure which has been described with the reference to the figures appears to be the preferred structure, it will be understood that various modifications may be made thereto without going beyond the scope of the invention. In particular, the geometrical shape of the magnetic core may be different and for example it may be polygonal.

I claim:

1. A polyphase transformer for oil immersion cooling within a tank and having a magnetic core for each phase, said cores being in contact with each other and oriented vertically and having two adjacent rectangular sides each of which is disposed against one of the rectangular sides of an adjacent magnetic core, and each core threading a coil which comprises a high tension winding of trapezoidal right cross-section and a low tension winding of rectangular right cross-section, with said trapezoidal right cross-section high tension winding radially surrounding the low tension winding, each magnetic core being symmetrical about the plane of symmetry of two adjacent coils and being resin impregnated, the improvement wherein: said magnetic cores are sawn into two parts along a plane perpendicular to the plane of symmetry, said two parts being stuck together and being made from magnetic sheets of at least two different widths so as to provide a right cross-section including at least one step and said two adjacent sides forming a core cross-section of pseudo-elliptical shape such that the uppermost coil is horizontally disposed to form cooling channels which are vertically oriented to insure adequate cooling of all coils, and wherein single wedges lie in the plane of symmetry of given cores which thread both of two adjacent coils and are interposed between opposed coplanar sides of opposed trapezoidal right cross-section high tension windings to jam the coils both axially and radially by orthogonal tightening force components perpendicular to the plane of symmetry of the coil and parallel thereto, so as to oppositely mutually wedge adjacent coils.

* * * * *